United States Patent [19]

Graham

[11] Patent Number: 4,689,632

[45] Date of Patent: Aug. 25, 1987

[54] REFLECTOR ANTENNA SYSTEM HAVING REDUCED BLOCKAGE EFFECTS

[75] Inventor: William J. Graham, Bensalem, Pa.

[73] Assignee: RCA Corporation, Princeton, N.J.

[21] Appl. No.: 739,429

[22] Filed: May 30, 1985

[51] Int. Cl.[4] ..... H01Q 19/19; H01Q 19/10

[52] U.S. Cl. ..... 343/781 P; 343/781 R; 343/781 CA; 343/782; 343/837

[58] Field of Search ..... 343/781 CA, 781 P, 782, 343/775, 837, 912–914, 754, 755, 779

[56] References Cited

U.S. PATENT DOCUMENTS

| | | | |
|---|---|---|---|
| 2,370,053 | 12/1940 | Lindenblad | 343/782 X |
| 2,803,009 | 8/1957 | Seamans | 343/782 |
| 3,195,137 | 7/1965 | Jakes, Jr. | 343/837 X |
| 3,218,643 | 11/1965 | Hannan et al. | 343/781 CA X |
| 3,231,893 | 1/1966 | Hogg | 343/837 X |
| 3,235,870 | 2/1966 | Hannan | 343/781 CA X |
| 4,274,098 | 6/1981 | Renau et al. | 343/781 CA |
| 4,500,882 | 2/1985 | Katagi et al. | 343/782 X |
| 4,509,055 | 4/1985 | Fassett | 343/754 |

*Primary Examiner*—Marvin L. Nussbaum

*Attorney, Agent, or Firm*—Clement A. Berard, Jr.; Raymond E. Smiley; Robert Ochis

[57] ABSTRACT

A reflector antenna system with reduced blockage effects is provided by placing a compensating reflector between the surface of the main curved reflector and its primary feed to intercept illuminating radiation which would otherwise be blocked by the feed. The compensating reflector reflects the intercepted radiation with a beam pattern which is essentially identical to the substractive blockage pattern. The compensating reflector is spaced from the main reflecting surface to place its beam pattern in phase opposition to the blockage pattern to cancel common components from the blockage pattern.

12 Claims, 12 Drawing Figures

REFLECTOR ANTENNA SYSTEM HAVING REDUCED BLOCKAGE EFFECTS

BACKGROUND OF THE INVENTION

The present invention relates to the field of radio frequency reflector antenna systems and more particularly to such antenna systems where the antenna feed blocks a portion of the radiation from the antenna reflector.

Many reflector antennas suffer from blockage. Blockage is a particular problem in antenna systems in which a reflecting dish is illuminated by a feed located along the axis of the dish. In such an antenna system a portion of the radiation emitted by the feed and reflected from the reflector strikes the feed and is blocked by the feed and excluded from the reflected collimated beam produced by the reflector. This exclusion of radiation from the collimated beam is referred to as blockage. Blockage can adversely effect the antenna's beam pattern by reducing the gain of the antenna, reducing its directivity, and increasing the amplitude of the beam pattern sidelobes.

The effects of blockage can be reduced by shrinking the size of the feed. However, that is not always feasible and there is always a limit to how much a feed may be shrunk. Another alternative is to displace the feed from the axis of the dish to avoid blocking the central portion of the beam. Unfortunately, such an offset feed for a dish reflector causes undesirable cross polarization. Thus, an offset feed introduces its own detrimental effects. As a consequence, offset feeds are not a favored solution to the blockage problem.

An improved reflector antenna system design is needed which reduces the adverse effects of blockage without itself introducing other undesired effects.

SUMMARY OF THE INVENTION

A reflector antenna system in accordance with the present invention reduces blockage effects without introducing other undesirable effects. This antenna system includes a blockage compensation reflector positioned to intercept feed radiation blocked from the collimated beam by the feed.

DETAILED DESCRIPTION

Figure 1:
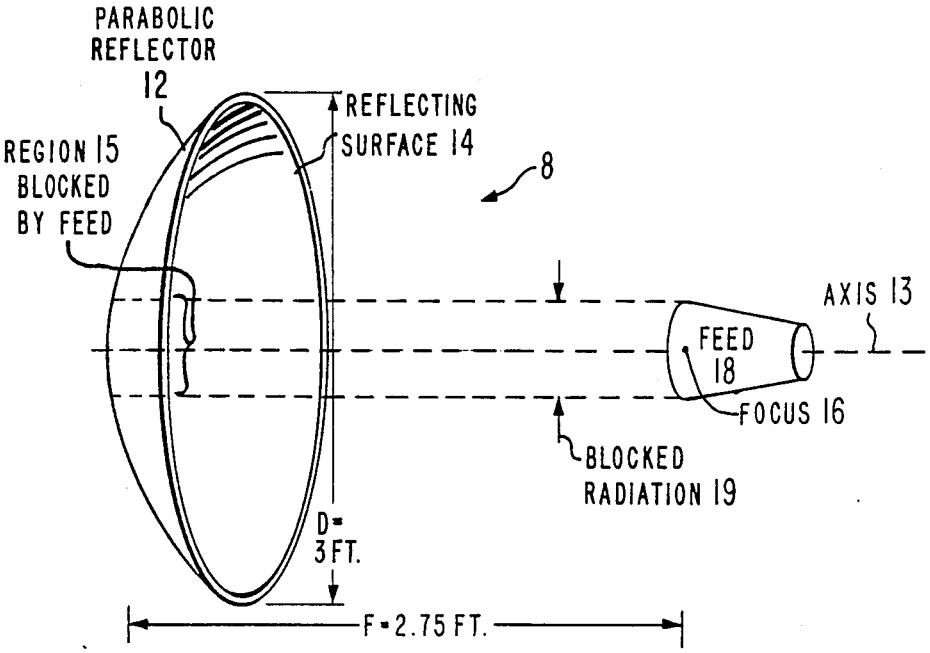
Fig. 1 PRIOR ART
FIG. 1 is a perspective view of a prior art parabolic dish reflector antenna system in which blockage adversely affects the beam pattern.

In FIG. 1 a prior art reflector antenna system 8 is illustrated. This antenna system includes a parabolic reflector 12 having a reflecting surface 14 and a feed 18 located along axis 13 at focal point 16 of the reflector 12. The reflector 12 for example has a diameter D of 3 feet (0.91 meter) and a focal length F of 2.75 feet (0.838 meter) which results in a F/D ratio of $\sqrt{3}/2$. This reflector is shaped or curved in two mutually perpendicular coordinates. Its projection on a plane perpendicular to axis 13 may be circular or of some other configuration. The antenna system 8 may have an operating radio frequency of 5.65 GHz.

Antenna system 8 suffers from blockage due to feed 18. The feed 18, for example is circular and has a diameter of 7 inches (17.8 centimeters). Because of the 7 inch (17.8 centimeter) diameter of the feed 18; the feed radiation which is reflected from reflecting surface 14 in a circular region about 7 inches (17.8 centimeters) in diameter centered at the axis 13 is blocked by the feed 18.

Each of the antenna patterns illustrated in the accompanying FIGURES was generated by a computer simulation program which plots the amplitude of the beam pattern of an antenna from the geometric configuration of the antenna as specified to the simulation program in its input data.

Figure 2:
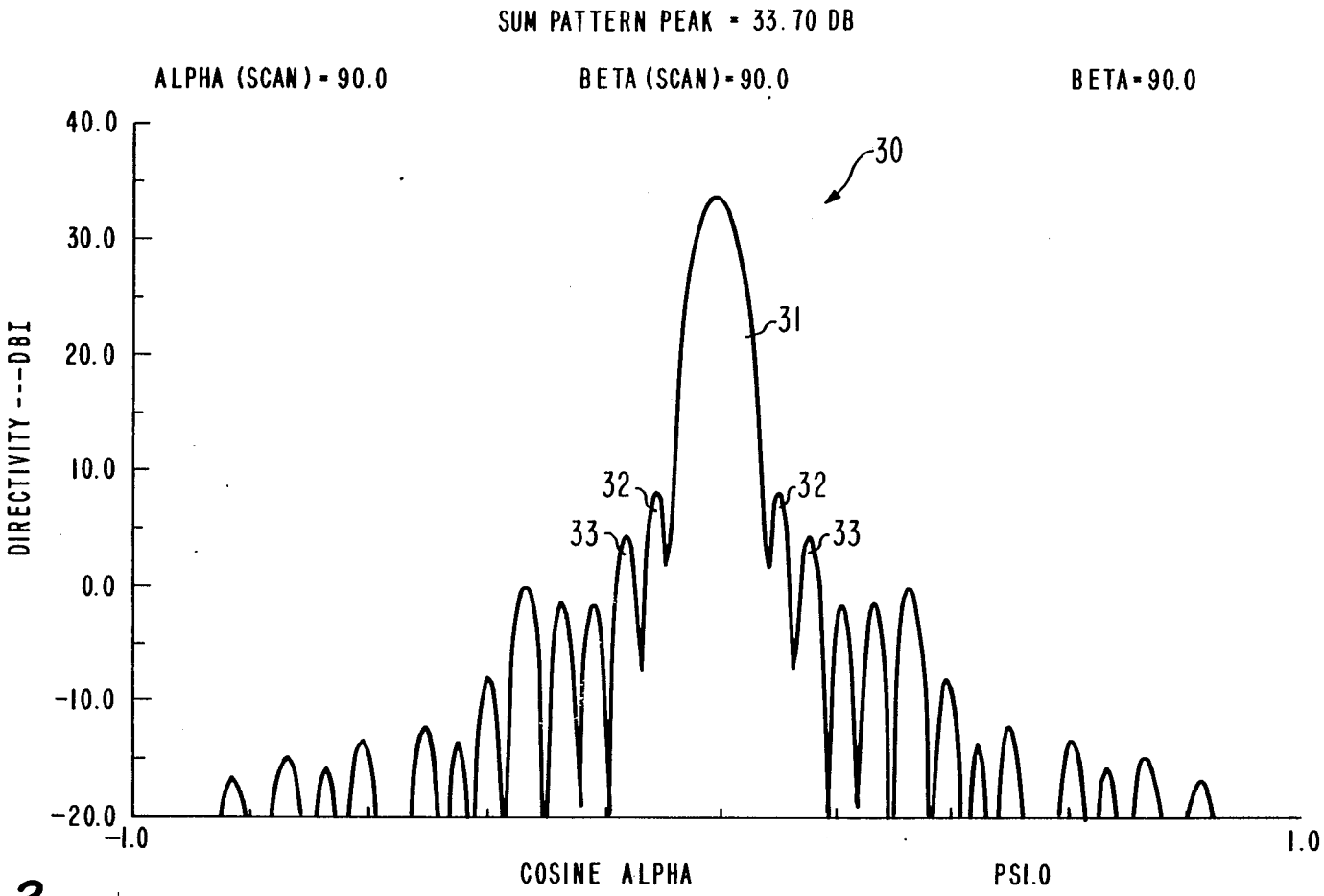
FIG. 2 is a plot of the amplitude of the beam pattern which would be produced by the antenna in FIG. 1 if there were no blockage.

The amplitude of the design beam pattern of this antenna is illustrated by the curve 30 in FIG. 2 The beam pattern 30 has a main lobe 31, first sidelobes 32 and second sidelobes 33. The other sidelobes are not identified by reference numerals. The peaks of the first sidelobes 32 are 24.75 dB below the peak of the main lobe 31. This is referred to as a sidelobe level of minus 24.75 dB. This pattern is determined under the assumption that there is no blockage from the feed. Thus, the curve 30 is not a physically realizable pattern with a feed actually at the focus. However, it is a goal against which the design of such an antenna can be measured.

Figure 3:
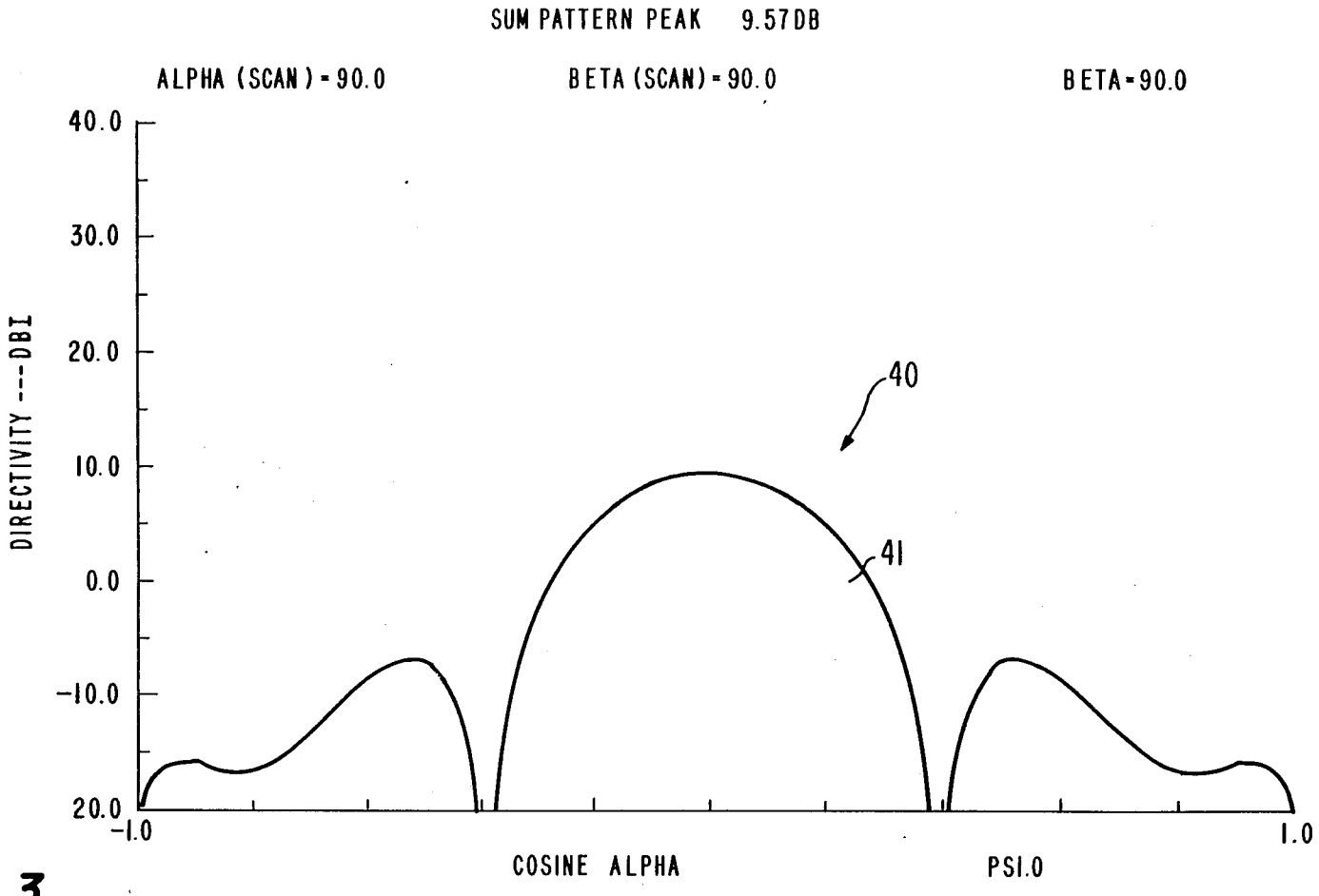
FIG. 3 is a plot of the amplitude of the beam pattern of the blockage in the antenna system in FIG. 1.

The beam pattern of the blockage is illustrated by the curve 40 in FIG. 3. This blockage has a main lobe 41. This blockage pattern has a relatively wide beamwidth because it results from a physically small source. This blockage pattern 40 is out of phase with the pattern 30 because the blocked radiation is subtracted from the collimated beam produced by main reflecting surface 14. This subtractive nature of the blockage pattern is a result of the exclusion of the blocked radiation from the collimated beam combined with the fact that the pattern 30 is determined on the assumption that all of the feed radiation which strikes the reflector 12 contributes to the collimated beam.

Figure 4:
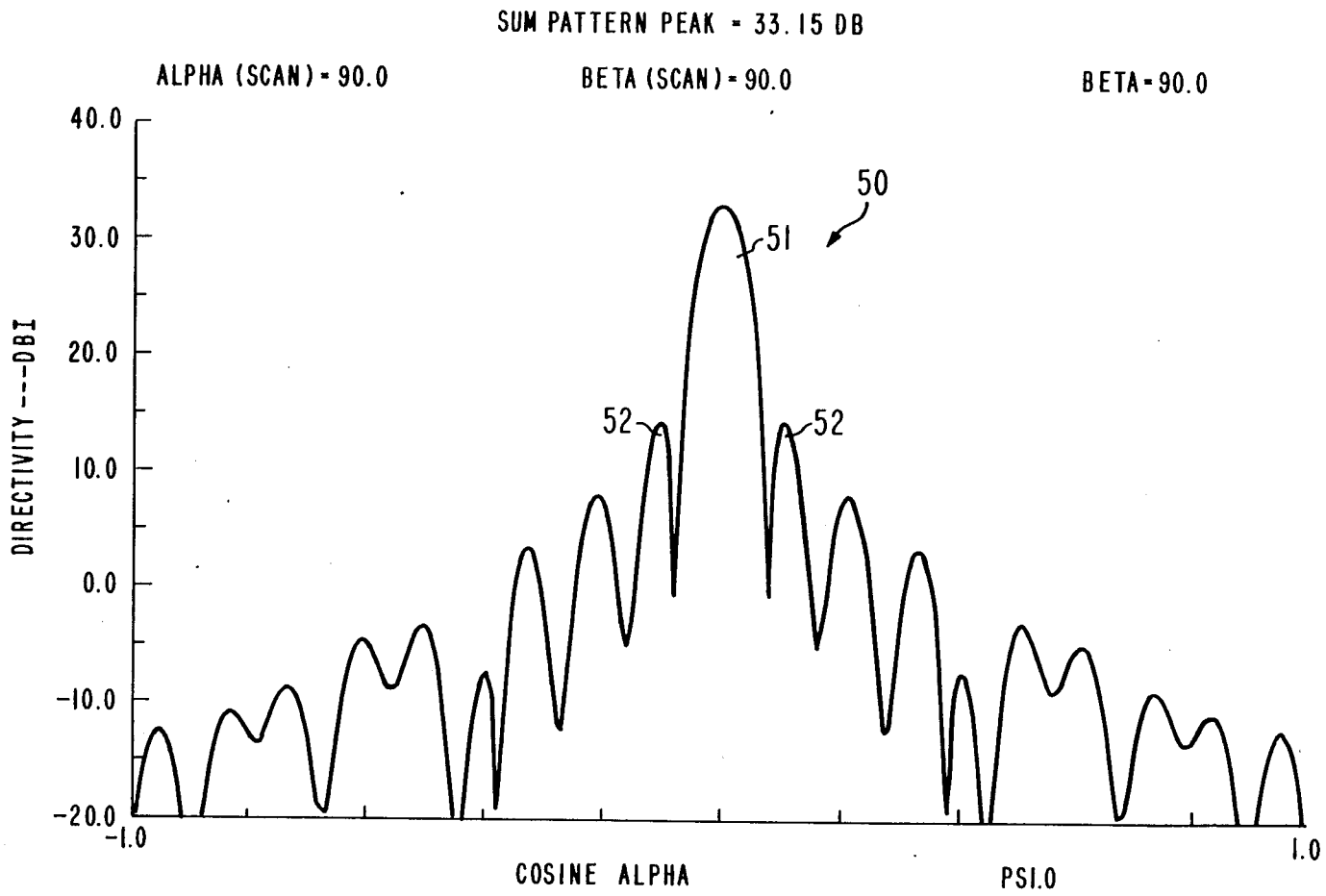
FIG. 4 is a plot of the amplitude of the beam pattern of the antenna in FIG. 1 with the effects of blockage included.

Curve 50 in FIG. 4 illustrates the actual antenna beam pattern characteristics of the antenna 8. The pattern 50 has an actual first sidelobe 52 peak level which is 18.5 dB below the peak of the main lobe 51. This higher sidelobe level (less negative) as compared to pattern 30 is one of the impairments of the beam pattern which results from the blockage. Since the blockage adds to the first sidelobe, it is in-phase with the first sidelobe.

Figure 5:
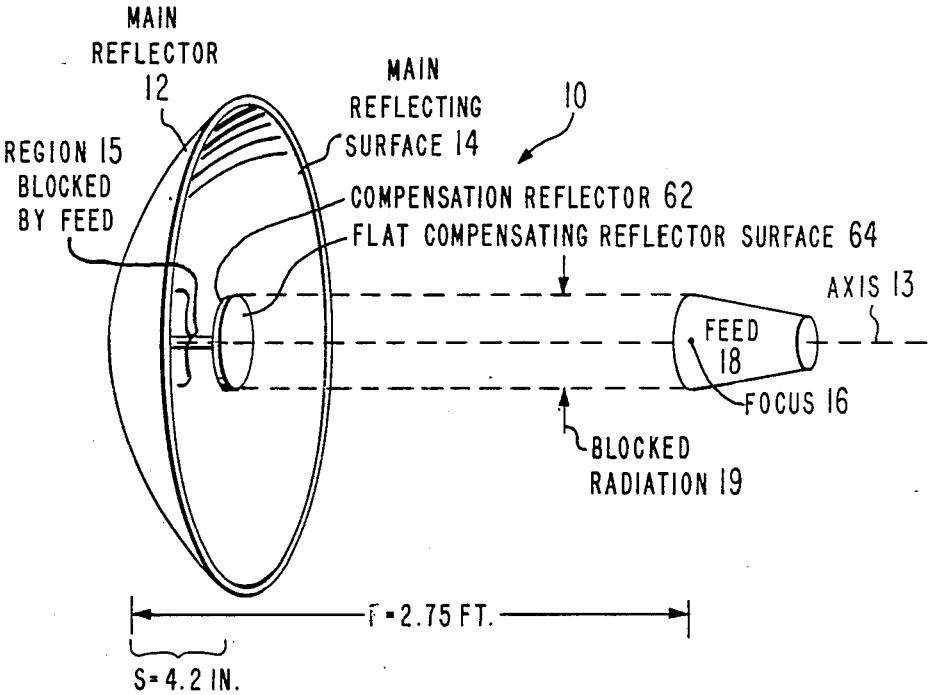
FIG. 5 is a perspective view of a parabolic dish reflector antenna system similar to that in FIG. 1, but which in accordance with the present invention includes a preferred blockage compensation reflector.

In FIG. 5, a reflector antenna system 10 in accordance with the present invention is illustrated. This reflector antenna system 10 has a main reflector 12 having a main reflecting surface 14 and a feed 18 located at the focus 16 of reflector 12. These elements of antenna system 10 are identical to the corresponding elements of prior art antenna 8. In addition to these prior art elements an additional reflector 62 is located in front of the main reflecting surface 14 and centered on the antenna axis 13. This additional reflector is referred to as a compensation reflector and is positioned to intercept the feed radiation which would be blocked by the feed 18 in the prior art antenna 8. Compensating reflector 62 may preferably be supported by a post attached to its back side and located within the shadow of reflector 62. Compensaton reflector 62 has a compensating reflecting surface 64. The compensating reflecting surface 64 is placed at a separation distance S of two wavelengths from the main reflecting surface 14. For the illustrated antenna system with an operating freuency of 5.65 GHz, this two-wavelength distance is 4.2 inches (10.7 centimeters). Reflecting surface 64 is spaced from surface 14 in order that surface 64 will function as a physically separate reflector.

Figure 6:
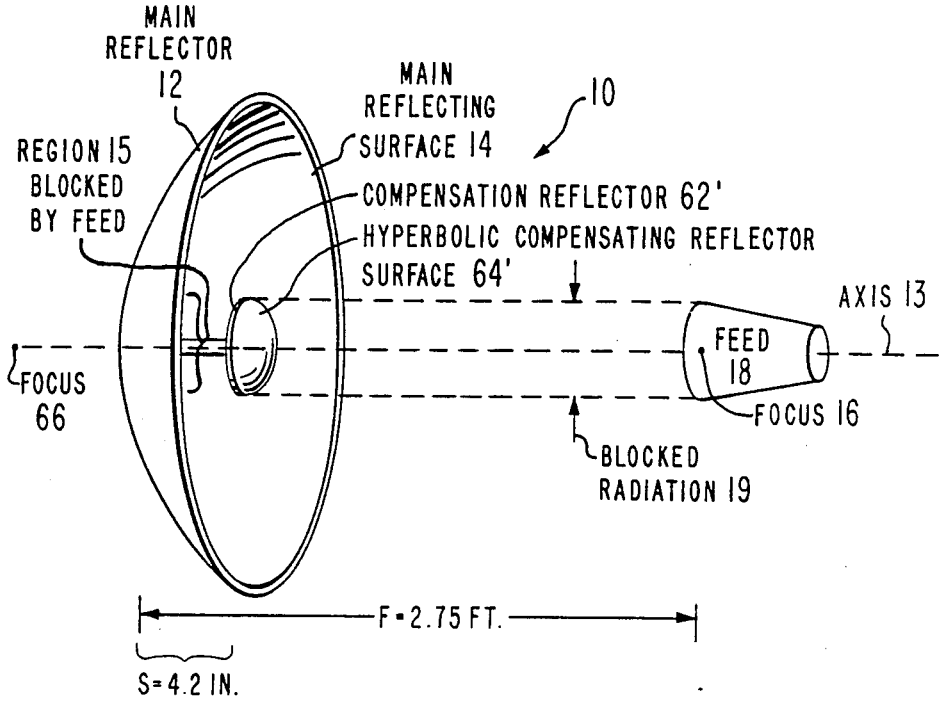
FIG. 6 is a view of an alternative compensating reflector.

The preferred configuration for the compensating reflecting surface 64 in antenna system 10 is a flat disk 7 inches (17.8 centimeters) in diameter. However, it is possible to make the compensating reflecting surface a different shape. A shape such as a segment of a hyperbolic surface or a cone may be used. In FIG. 6 the surface of compensating reflecting surface 64' is a segment of a hyperbolic surface having a focus 66. For a compensating reflecting surface 64' such as that in the FIG. 6 embodiment, the small diameter of the compensating reflector minimizes the effect which the curvature of the hyperbolic surface has on the beam pattern of the compensating reflector. Several simulations run with hyperbolic compensating reflecting surfaces 64' illustrate that a hyperbolic surface which is near to being a flat disk (that is, having a focal length at least 10 times the diameter of the compensation reflector) provides a better compensation for the blockage than a hyperbolic surface having a smaller ratio of focal length to diameter. For this simulation, the hyperbolic surface of the compensating reflector is defined by an axis which is colinear with the axis 13 of the main reflecting surface 14 such that the focus 16 of the main reflecting surface and the focus 66 of the compensation reflecting surface are colinear with the center of the compensating reflecting surface. It will be noted that the preferred flat disk compensating reflecting surface 64 is a limiting case of a hyperbolic surface as the ratio of its focal length to diameter becomes large.

The design pattern for this antenna is the pattern 30 of FIG. 2 and the blockage produced by the feed 18 is the blockage 40 of FIG. 3 which would yield a combined beam pattern 50 as in FIG. 4 if the compensating reflecting surface were not present. The compensating reflecting surface 64 has the same beam amplitude pattern as the blockage and thus, in the absence of blockage has the pattern 40 illustrated in FIG. 3. However, the compensating reflector pattern is also subject to blockage by the feed.

Figure 7:
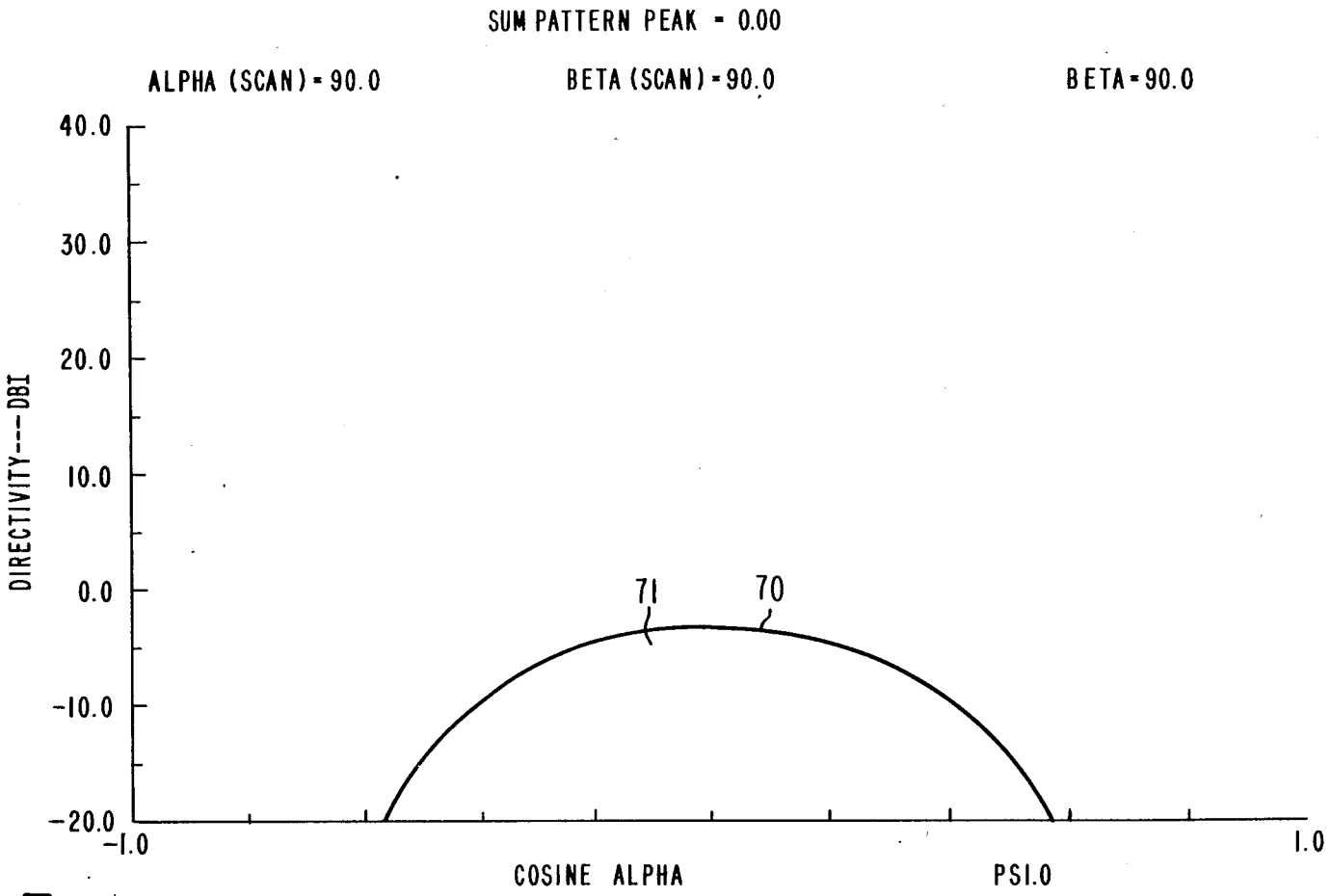
FIG. 7 is a plot of the amplitude of the beam pattern of the blockage which is present in the pattern of the FIG. 5 antenna.

The compensating reflecting surface 64 is spaced from the main reflecting surface 14 in order that the beam pattern of the compensating reflecting surface 64 may be maintained 180° out of phase with respect to the blockage pattern 40 of FIG. 3. This may be accomplished by positioning the compensating reflecting surface an integral number of half wavelengths from the main reflecting surface so that the round trip distance from the compensating reflecting surface to the main reflecting surface and back to the compensating reflecting surface is an integral number of wavelengths. Under these conditions, the common portions of the beam patterns of the compensating reflecting surface and the blockage cancel. The blockage which remains has the beam amplitude pattern 70 plotted in FIG. 7. This pattern has only a main lobe 71 and is the net blockage which is present in the antenna system 10 as a result of the combination of the primary blockage pattern 40 and the pattern of the compensating reflector 62.

Figure 8:
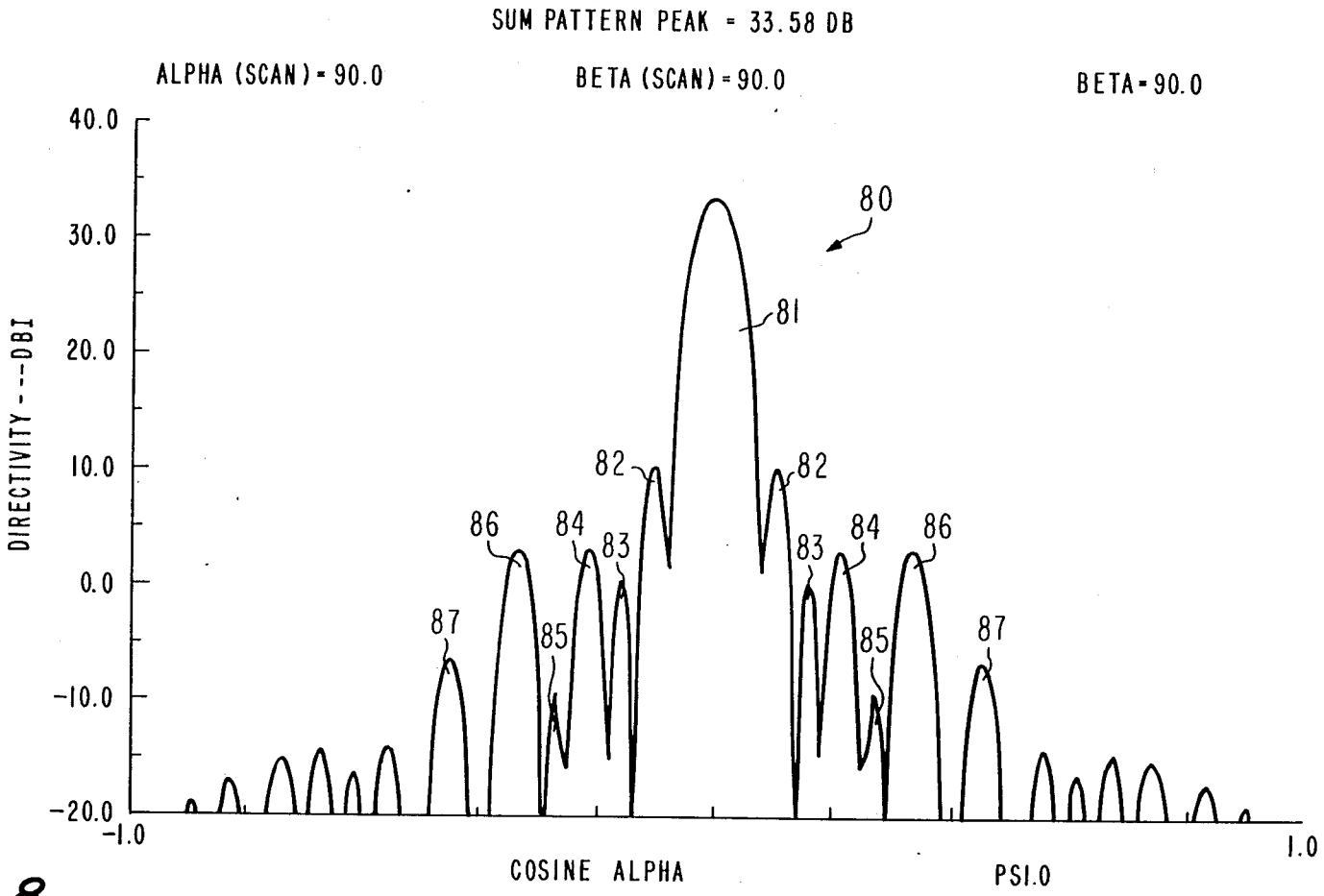
FIG. 8 is a plot of the overall amplitude of the beam pattern of the antenna system in FIG. 5.

The combined effect of the antenna pattern 30, the blockage pattern 40 and the compensating pattern 70 is illustrated by the curve 80 in FIG. 8. This pattern has its first sidelobes 82 at a level of −22.5 dB with respect to the peak of the main lobe 81 of the pattern 80. The close in lower sidelobes 83–87 have amplitudes ranging from −30 dB to −45 dB with respect to the peak of the main lobe 81. The other sidelobes in this pattern have still lower amplitudes.

Figure 9:
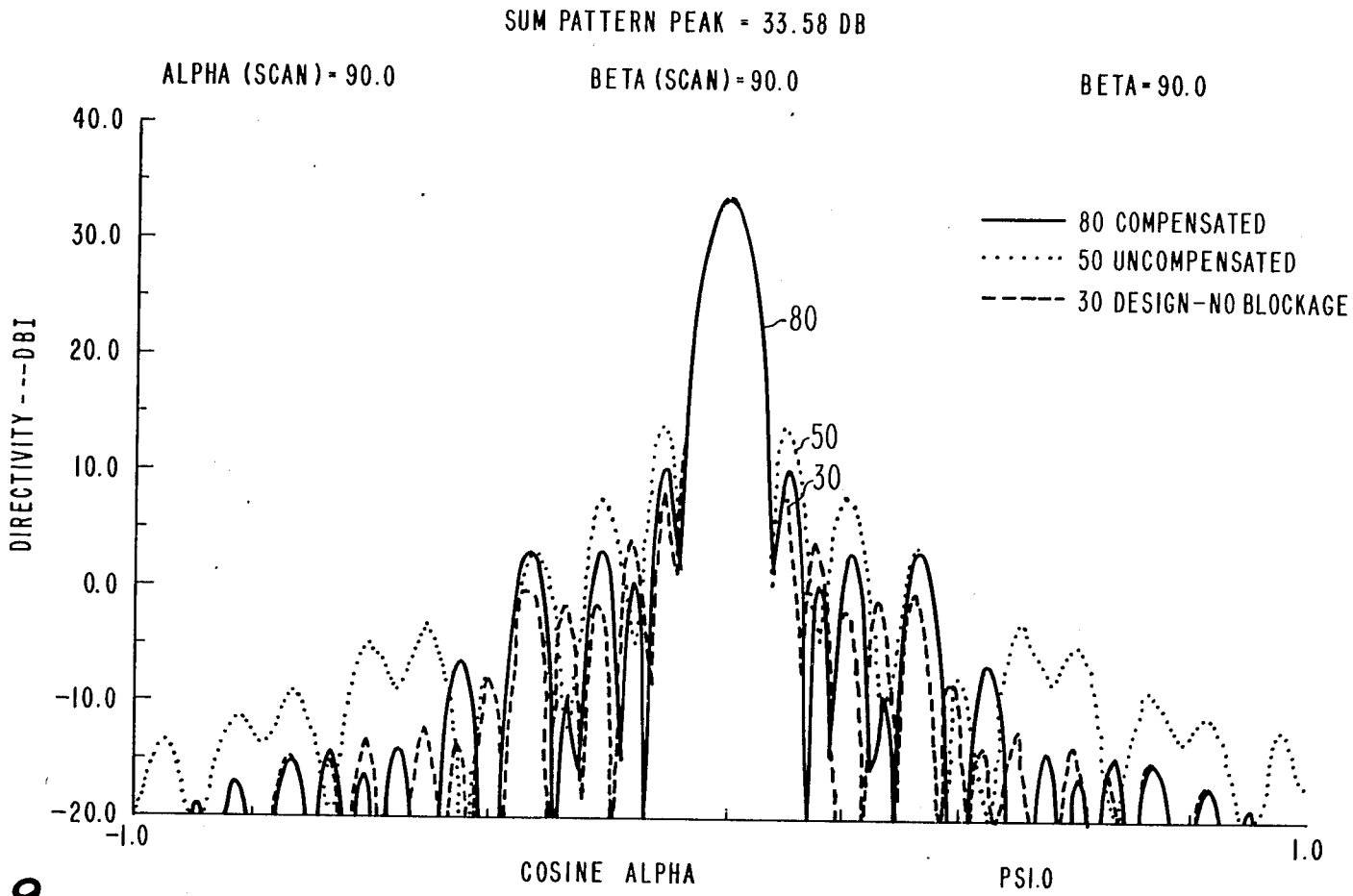
FIG. 9 is a plot in which the sum beam patterns of FIGS. 2, 4 and 8 are superposed on a common set of coordinate axes.

In FIG. 9 the curves 80 (the design pattern with compensated blockage in accordance with the present invention), 50 (the design pattern with normal blockage) and 30 (the design pattern alone) are superposed on the same set of axes. The curve 80 is shown as a solid line, the curve 50 as a dotted line and the curve 30 as a dashed line. From this superposition of patterns, it can be clearly seen that the peak sidelobe level of pattern 80 is substantially lower than the peak sidelobe level of pattern 50 of the prior art antenna 8. Thus, blockage compensation in accordance with the present invention improves the peak sidelobe level of the actual pattern of the antenna 10 over that of prior art antenna 8. There are also improvements in antenna gain and beam directivity in the pattern 80 as compared to the pattern 50. These differences are difficult to discern in a plot like that in FIG. 9; however, their existence is clearly demonstrated by the simulation program which produced the plots shown in FIGS. 2–4 and 7–9.

Figure 10:
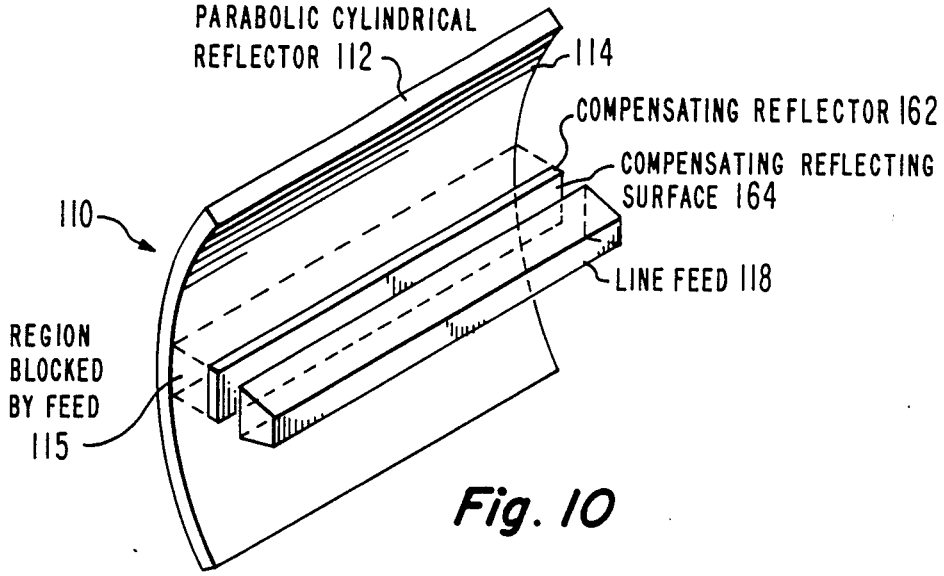
FIG. 10 is a perspective view of a parabolic cylindrical reflector antenna system in accordance with the present invention.

The FIG. 1–9 illustrations are for a parabolic dish antenna whose feed 18 is located at the focus of that parabolic dish. The present invention is not limited to such systems. It is also applicable to parabolic cylindrical reflector antenna systems. For a cylindrical reflector, both the feed and the compensation reflector are preferably long in direction parallel to the length of the focus, respectively to illuminate the whole length of the cylindrical reflector and to intercept all of the radiation that would be blocked by the feed. An example of such a cylindrical antenna system is shown generally at 110 in FIG. 10. System 110 includes a parabolic cylindrical reflector 112 having a reflecting surface 114, a line feed 118 located along the focus of the reflector 112 and a compensating reflector 162 whose reflecting surface 164 intercepts feed radiation which would strike the region 115 of surface 114. Region 115 is that part of surface 114 whose reflected radiation would strike feed 118 and be blocked. Since this reflector is cylindrical, it is contoured along only one co-ordinate (its vertical axis) in FIG. 10.

Figure 11:
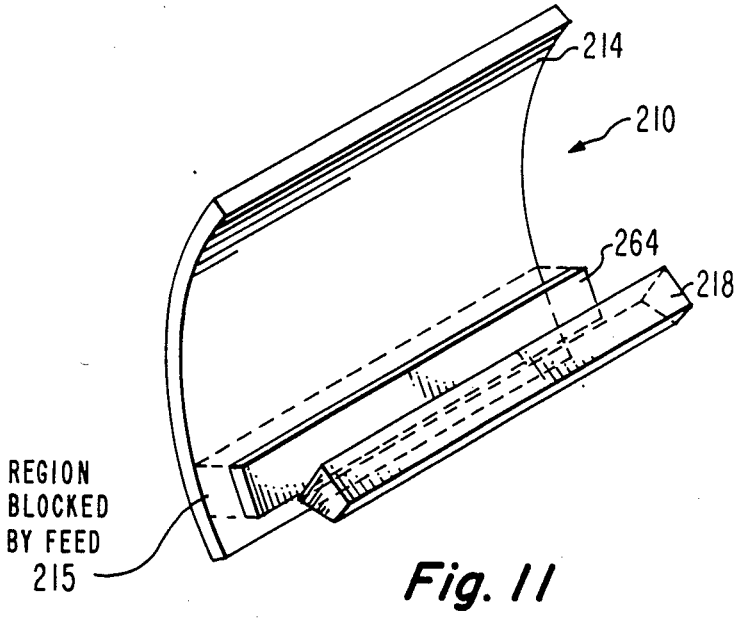
FIG. 11 is a perspective view of a displaced feed reflector antenna system in accordance with the present invention.

The invention is applicable to any antenna having a curved main reflecting surface and a feed which at least partially blocks radiation reflected from that surface. Thus, it is also applicable to antennas whose main reflecting surface is not parabolic and/or whose feeds are displaced from the focus of the reflector. An example of a system in which the feed is displaced from the axis of the reflector is shown at 210 in FIG. 11. In System 210 the feed 218 blocks the radiation reflected from region 215 of main reflecting surface 214 and compensating reflecting surface 264 intercepts the feed radiation which would strike region 215.

Figure 12:
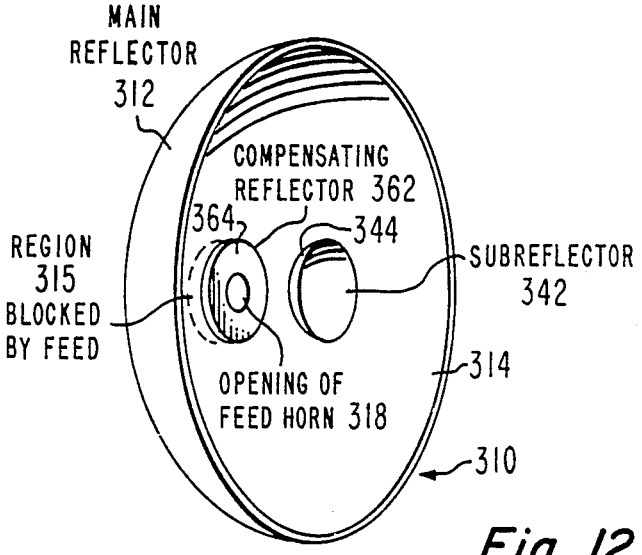
FIG. 12 is a perspective view of a cassegrain antenna system in accordance with the present invention.

Thus far, the present invention has been shown and described in terms of reflector antenna systems in which there is a main reflecting surface which is directly illuminated by a feed horn. However, this invention is also applicable to other reflector antenna systems in which the feed system includes one or more intermediate reflectors disposed in the radiation path from the feed horn to the main reflecting surface. A cassegrain antenna system 310 in FIG. 12 is one example of this later type since its feed system includes both a feed horn 318 and a subreflector 342 for redirecting the feed radiation into the main reflector 312. In such a cassegrain system, the compensating reflecting surface 364 may surround the feed horn 318 and have an aperture therein for the passage of the feed horn or its radiation. In that situation the compensating reflector is sized and shaped to compensate for the blockage (region 315) caused by the subreflector 342 and its reflecting surface 344.

In order to minimize the net blockage (that which remains after compensation) it is preferred to configure the compensating reflecting surface to intercept substantially all of the feed radiation that would be blocked by the feed and substantially none of the feed radiation which would not be blocked by the feed. However, more or less may be intercepted as is found most advantageous in a given system.

Since the intended function of the compensating reflecting surface is to compensate for blockage, the compensating reflector should not be so much larger than the blockage region that it increases the blockage thereby adversely affecting the beam pattern characteristics of the overall antenna. Similarly, a smaller compensating reflecting surface would not cancel as much of the blockage as a full sized compensating reflector. If the actual shape of the blockage is unknown or uncertain, then the most effective shape for the compensating reflector may be determined experimentally in an antenna test system.

Naturally, where the separation distance S of the compensating reflector from the main reflector is an odd multiple of $\lambda/4$, the effect of the blockage is increased because the compensating beam is in phase with the original blockage and thus adds to it. This increased blockage effect increases the peak sidelobe level of the antenna to above its level in the absence of the compensating reflector.

Where the compensating reflector is spaced a distance $S=n\lambda/2$ from the main reflector surface, there is a specific value of n which for a given compensating reflector results in the largest reduction in peak sidelobe level. This is believed to be a result of two competing effects. As the compensating reflector is moved closer to the feed as n is increased, the value of r decreases in the expression $P/4\pi r^2$ for the intensity of the feed radiation's field strength. As a result, the amount of energy intercepted by the compensating reflector increases. The other of these effects is an increase in the blockage suffered by the reflected compensating radiation which results from the reduced spacing of the compensating reflector from the feed which causes the feed to subtend a larger angle as viewed from the compensating reflector.

The bandwidth of the compensating effect depends on the value of n and the bandwidth of the antenna in a prior art configuration. If extremely accurate tuning of the compensation effect for particular operating frequencies is needed, then the post on which the compensating reflector is mounted can be extended and retracted with operating frequency changes to place the compensating reflector in its optimum position at each operating frequency.

The benefits of the compensating reflector of this invention have been experimentally confirmed by measurements taken on an antenna which has a diameter of 4 feet (1.22 meter), with a focal length of 18 inches (45.7 cm) and a blocked region 15 in FIG. 5 which has a diameter of 4.2 inches (10.7 cm). At a frequency of 5.65 GHz (a wavelength of 2.1 inch (5.3 cm)), this antenna has a measured nominal gain of 32 dB and a measured nominal peak sidelobe level of 19 dB. Both of these nominal values are for a prior art configuration in which no compensating reflector is included. A compensating disk having a diameter of 4.2 inches (10.7 cm) and spaced 8.4 inches (21.3 cm) from the main reflector decreased the peak sidelobe level by as much as 6 dB and increased the gain by as much as 0.6 dB.

What is claimed is:

1. A radio frequency antenna system comprising:

a main reflector having a curved main reflecting surface configured to reflect illuminating radio frequency radiation as a collimated beam;

means for illuminating said main reflecting surface with illuminating radio frequency radiation, said means for illuminating being positioned, configured and oriented to cause said main reflecting surface to reflect said illuminating radiation into the ambient environment as a collimated beam, said means for illuminating being located where it would block the illuminating radiation reflected from a segment of said main reflecting surface thereby excluding that portion of said illuminating radiation from said collimated beam and impairing the beam pattern of said antenna system relative to its beam pattern in the absence of that blockage; and a blockage compensation reflector having a compensating reflecting surface positioned and configured to intercept at least part of said excluded illuminating radiation and to reflect said intercepted radiation directly into said ambient environment with a beam pattern which at least partially compensates for said beam pattern impairing effects of said blockage, said intercepted radiation being intercepted without having been reflected from said main reflecting surface.

2. The antenna system recited in claim 1 wherein:

said main reflecting surface has a substantially parabolic contour in at least one dimension; and said means for illuminating is located in the vicinity of the focus of said substantially parabolic contour.

3. The antenna system recited in claim 2 wherein:

said compensating reflecting surface has a substantially hyperbolic contour.

4. The antenna system recited in claim 3 wherein:

said compensating reflecting surface is a segment of a substantially hyperbolic surface having a focal length which is at least ten times the diameter of said compensatin reflector.

5. The antenna system recited in claim 2 wherein:

said compensating reflecting surface is a substantially flat disk.

6. The antenna system recited in claim 1 wherein:

said compensating reflecting surface is located between said means for illuminating and said main reflecting surface.

7. The antenna system recited in claim 6 wherein:

said compensating reflecting surface is spaced from said main reflecting surface by substantially an integral multiple of a half wavelength at an operating frequency of said antenna system.

8. The antenna system recited in claim 1 wherein:

said compensating reflecting surface is configured to intercept only said excluded radiation.

9. The antenna system recited in claim 1 wherein:

said compensating reflecting surface is configured to intercept substantially all of said excluded radiation.

10. The antenna system recited in claim 1 wherein:

said main reflecting surface is contoured in only one coordinate.

11. The antenna system recited in claim 1 wherein:

said main reflecting surface is contoured in two mutually perpendicular coordinates.

12. The antenna system recited in claim 1 wherein said antenna system is a cassegrain system in which:

said means for illuminating comprises a feed horn in the vicinity of said main reflecting surface and a subreflector positioned in the vicinity of the focus of the main reflector and said compensation reflector has an aperture therein for the passage of said feed horn or its radiation.

* * * * *